US006518715B1

(12) United States Patent
Reinig

(10) Patent No.: US 6,518,715 B1
(45) Date of Patent: Feb. 11, 2003

(54) CIRCUIT ARRANGEMENT FOR THE ENERGY-SAVING OPERATION OF A FLUORESCENT TUBE

(75) Inventor: Werner Reinig, Puschendorf (DE)

(73) Assignee: Future New Developments Limited, Grand Cayman (KY)

( * ) Notice: Subject to any disclaimer, the term of this patent is extended or adjusted under 35 U.S.C. 154(b) by 0 days.

(21) Appl. No.: 09/762,695

(22) PCT Filed: Sep. 30, 1999

(86) PCT No.: PCT/EP99/07256

§ 371 (c)(1),
(2), (4) Date: Mar. 19, 2001

(87) PCT Pub. No.: WO00/21342

PCT Pub. Date: Apr. 13, 2000

(30) Foreign Application Priority Data

Oct. 1, 1998 (DE) ..... 198 45 131
Oct. 1, 1998 (DE) ..... 298 17 509 U
Nov. 18, 1998 (DE) ..... 198 53 138

(51) Int. Cl.[7] ..... H05B 37/00

(52) U.S. Cl. ..... 315/291; 315/263; 315/DIG. 5; 362/366

(58) Field of Search ..... 315/246, 248, 315/291, 247, 249, 260–263, 274, 276, 194, 94–97, DIG. 5; 362/366, 364, 66, 365

(56) References Cited

U.S. PATENT DOCUMENTS

| | | | | |
|---|---|---|---|---|
| 3,778,609 A | | 12/1973 | Liberman | 240/73 HA |
| 4,475,064 A | | 10/1984 | Burgess | |
| 4,947,297 A | | 8/1990 | Druffel et al. | 362/147 |
| 5,039,915 A | * | 8/1991 | Lu | 315/DIG. 5 |
| 5,130,914 A | | 7/1992 | Bengochea | 362/364 |
| 5,145,249 A | | 9/1992 | Bruckner | 362/365 |
| 5,289,358 A | | 2/1994 | Halemeier | 362/365 |
| 5,291,381 A | | 3/1994 | Price | 362/366 |
| 5,568,018 A | * | 10/1996 | Muzic | 315/DIG. 5 |
| 5,581,488 A | | 12/1996 | Harwood | 362/147 |
| 5,609,408 A | | 3/1997 | Targetti | 362/66 |
| 5,609,413 A | | 3/1997 | Lecluze | 362/364 |
| 5,823,664 A | | 10/1998 | Demshki, Jr. et al. | 362/366 |
| 5,834,899 A | * | 11/1998 | Lovell et al. | 315/248 |
| 6,036,337 A | | 3/2000 | Belfer | 362/287 |
| 6,082,878 A | | 7/2000 | Doubek et al. | 362/365 |

FOREIGN PATENT DOCUMENTS

| | | |
|---|---|---|
| DE | 36 32272 A1 | 9/1986 |
| EP | 0 111 296 A1 | 6/1984 |
| EP | 0 622 977 A2 | 11/1994 |
| WO | WO 94/14301 | 6/1994 |

OTHER PUBLICATIONS

Darklight Fixtures 56/45AA–LV and 56/20AA–LV recessed low voltage accent lights, Edison Price Lighting Catalog, 1993, pp. 2–8.

Fixture #KL9120PAR56LVADJCFF recessed adjustable downlight, Kramer Lighting, Inc. Catalog, pp. 29.

* cited by examiner

*Primary Examiner*—Don Wong
*Assistant Examiner*—Wilson Lee
(74) *Attorney, Agent, or Firm*—Thomas R. FitzGerald, Esq.

(57) ABSTRACT

The invention relates to a circuit arrangement for energy-saving operation of a fluorescent tube (1) whereby two respective connections (2*a*, 2*b*, 3*a*, 3*b*) are arranged on the end caps (1*a*, 1*b*) of said tube. The fluorescent tube is mechanically and electrically linked to brackets (8, 9) via said connections (2*a*, 2*b*, 3*a*, 3*b*) and can be connected to an alternating current supply (6) via a reactance coil (4) and a starter (5). The objective of the invention is to allow the fluorescent tube to be retrofitted in a simple manner. This is achieved by means of a quadrupole (4) circuit arrangement, whereby the input terminals (7*a*, 7*b*) of said quadrupole form a series connection with the two connections (2*a*, 2*b*, 3*a*, 3*b*) on one end cap (1*a*, 1*b*) and the reactance coil (4), whereby said circuit is connected in parallel to the alternating current source (6), and the output terminals (7*c*, 7*d*) of said quadrupole are electrically connected to the two connections (3*a*, 3*b*, 2*a*, 2*b*) on the other end cap (1*b*, 1*a*).

20 Claims, 5 Drawing Sheets

CIRCUIT ARRANGEMENT FOR THE ENERGY-SAVING OPERATION OF A FLUORESCENT TUBE

BACKGROUND OF THE INVENTION

1. Field of the Invention

The present invention relates to a circuit arrangement for the energy-saving operation of a fluorescent tube. The invention comprises two connections each at both end caps, is electrically of mechanically accommodated in brackets via the connections, and is connectable with an alternating current supply by interconnecting a reactance coil and a starter.

Such a fluorescent tube generally consists of a tubular discharge vessel made of glass, into the end caps of which thermionic cathodes are melted. The discharge vessel is generally evacuated and filled with argon and mercury. At both end caps, the thermionic cathodes are routed to the outside as two connections each. Such a fluorescent tube is then electrically and mechanically accommodated in brackets via these connections. The operation of such a fluorescent tube is mostly effected at an alternating current supply, with a reactance coil and a glow discharge igniter, simply referred to as starter, being required for striking the gas discharge. However, the reactance coil and the starter imply an additional energy consumption or a reduction of the efficiency, respectively. Due to the fact that such a fluorescent tube is a comparatively economical and reliable light source, an efficiency in the order of only 0.5 is accepted.

BACKGROUND OF THE INVENTION

2. Description of Related Art

It is known to use an electronic ballast—(elektronisches Vorschaltgerat) briefly referred to as EVG—for the energy-saving operation of a fluorescent tube. For this purpose, the EVG is connected between the alternating current supply and the connections of the fluorescent tube, with the reactance coil and the starter being replaced. From a circuit engineering point of view, the EVG thus represents a six-terminal network. By means of the EVG an efficiency in the order of nearly 1 can be achieved.

BRIEF SUMMARY OF THE INVENTION

A great disadvantage is that electrical appliances, such as e.g. lamps, in which conventionally operated fluorescent tubes are employed can only be retrofitted to an energy-saving operation with EVG under extremely high efforts and expenditures. This is because a retrofit would mean time and labour-intensive installation costs apart from the procurement cost of the EGV, because in addition to the reactance coil and the starter the entire cabling would have to be replaced.

The invention is therefore based on the object to develop a circuit arrangement which renders itself for retrofitting the initially mentioned fluorescent tube in a simple manner for the energy-saving operation.

The solution of this object is effected by a circuit arrangement for the energy-saving operation of a fluorescent tube, which comprises two connections each at both end caps, is electrically and mechanically accommodated in brackets via the connections, and is connectable with an alternating current supply by interconnecting a reactance coil and a starter, characterised in that the circuit arrangement is a quadripole which transforms the current fed to its input terminals from the alternating current supply into a high frequency current which is output and its output terminal, whose input terminals form a series connection with the two connections at the one end cap and the reactance coil, the series connection being connected in parallel to the alternating current supply, and whose output terminals are electrically connected with the two connections at the other end cap. According to the same, the inventive circuit arrangement constitutes a quadripole which can be connected with the existing cabling in a simple manner after the opening of two lines. When connecting the inventive circuit arrangement all that has to be done is to make sure that the input terminals of the quadripole form a series connection with the two connections at the one end cap and with the reactance coil, the series connection being connected in parallel to the alternating current supply, and that the output terminals of the quadripole are connected electrically with the two connections at the other end cap. In other respects, interchanging of individual connections or terminals, respectively, proves to be uncritical because of the alternating current operation. Likewise, the series connection comprising the input terminals of the quadripole, the two connections at the one end cap, and the reactance coil which is connected in parallel to the alternating current supply can have any order. Insofar, the connection of the inventive circuit arrangement can principally be performed by anybody. Furthermore, the already existing coil will be retained upon a connection, because it assumes the function of a pre-filter for the inventive circuit arrangement, so that the construction of the inventive circuit arrangement requires only a small installation space and can be implemented economically.

Depending on which site the line into which the starter is connected is opened upon connection the starter is located either to the input or the output side of the inventive circuitry. In order to ensure a current flow for the proper function of the circuit arrangement the starter is bridged. For this purpose it is simply replaced with a short-circuited design in its existing bracket. In the case in which the starter is located on the input side of the inventive circuit arrangement it can advantageously be replaced with an electric fuse which can be inserted into the existing bracket and additionally protects the inventive circuit arrangement against overload.

The inventive circuit arrangement can be retrofitted in a particularly advantageous manner if it is integrated in the fluorescent tube or in one of the end caps of the fluorescent tube, respectively. In this case, only the fluorescent tube has to be replaced so that any intervention into the existing cabling is omitted. A further alternative can be that the inventive circuit arrangement is integrated in one of the brackets accommodating the fluorescent tube. With this alternative, retrofitting merely requires the replacement of the bracket(s).

The invention also relates to an device for the connection of an inventive circuit arrangement with an initially mentioned fluorescent tube. This inventive device is defined by the features of the characterising clause of claim 12.

By means of the inventive circuit arrangement it is already possible to retrofit an initially mentioned fluorescent tube for the energy-saving operation in a simple manner. Now, the inventive device for the connection of an inventive circuit arrangement enables retrofitting in a particularly advantageous manner, which neither requires an intervention in the existing cabling of the fluorescent tube nor a replacement of the fluorescent tube or its accommodating bracket(s).

For this purpose, the inventive device, on the one hand, comprises two contact receptacles which electrically accommodate the two connections of one of the end caps. On the other hand, the inventive device comprises two connections which are electrically accommodated in one of the brackets. The connections and the contact receptacles of the inventive device are electrically insulated against each other, with the connections of the inventive device being electrically connected with the input terminals, and the contact receptacles of the inventive device being connected with the output terminals of the inventive circuit arrangement. Due to the fact that the contact receptacles and the connections are arranged coaxially to one another the inventive device is of such a narrow installation size that it fits between an end cap of the fluorescent tube and the associated bracket.

The great advantage therefore is that retrofitting of the inventive circuit arrangement by means of the inventive device can be carried out in a manner as simple as the replacement of the fluorescent tube. For this purpose, the existing fluorescent tube is removed from its brackets, then the inventive device is plugged onto the connections at one end cap, and subsequently the fluorescent tube together with the inventive device is re-inserted between the brackets.

The inventive circuit arrangement itself can be arranged remotely from the inventive device, depending on the installation conditions of the electrical appliance in which the fluorescent tube is arranged, while the electrical connection between the inventive device and the inventive circuit arrangement can be made in a flexible manner via an electric cable. Due to the fact that the inventive circuit arrangement is a quadripole, a four-wire cable is preferably used. Both the inventive device and the inventive circuit arrangement can be arranged in respective housings which are optionally provided with electrical connecting contacts for a simple connection by means of the cable.

In a particularly preferred manner, however, the inventive circuit arrangement is arranged in the housing of the inventive device or in a common housing, respectively. In the ideal case, the housing of the inventive device comprises an extension extending parallel to the longitudinal axis of the fluorescent tube, which accommodates the inventive circuit arrangement. In this manner, the inventive circuit arrangement and device can be retrofitted in a particularly simple way and without interfering with the constructional conditions.

As an essential for the invention the cost advantage should be mentioned which results from the fact that both standardised fluorescent tubes can remain in service and the standardised distance between the brackets accommodating the fluorescent tube can be retained.

Due to the advantages which can be achieved with the invention with respect to energy saving and simple retrofittability, the inventive circuit arrangement and device are suitable in a special manner for the use in electrical appliances in which one or several fluorescent tubes are operated, such as e.g. lamps, solar booth lamps or the like.

The invention and further advantageous features thereof will be explained in more detail in the following with reference to the drawing in which:

DETAILED DESCRIPTION OF THE INVENTION

Figure 1:
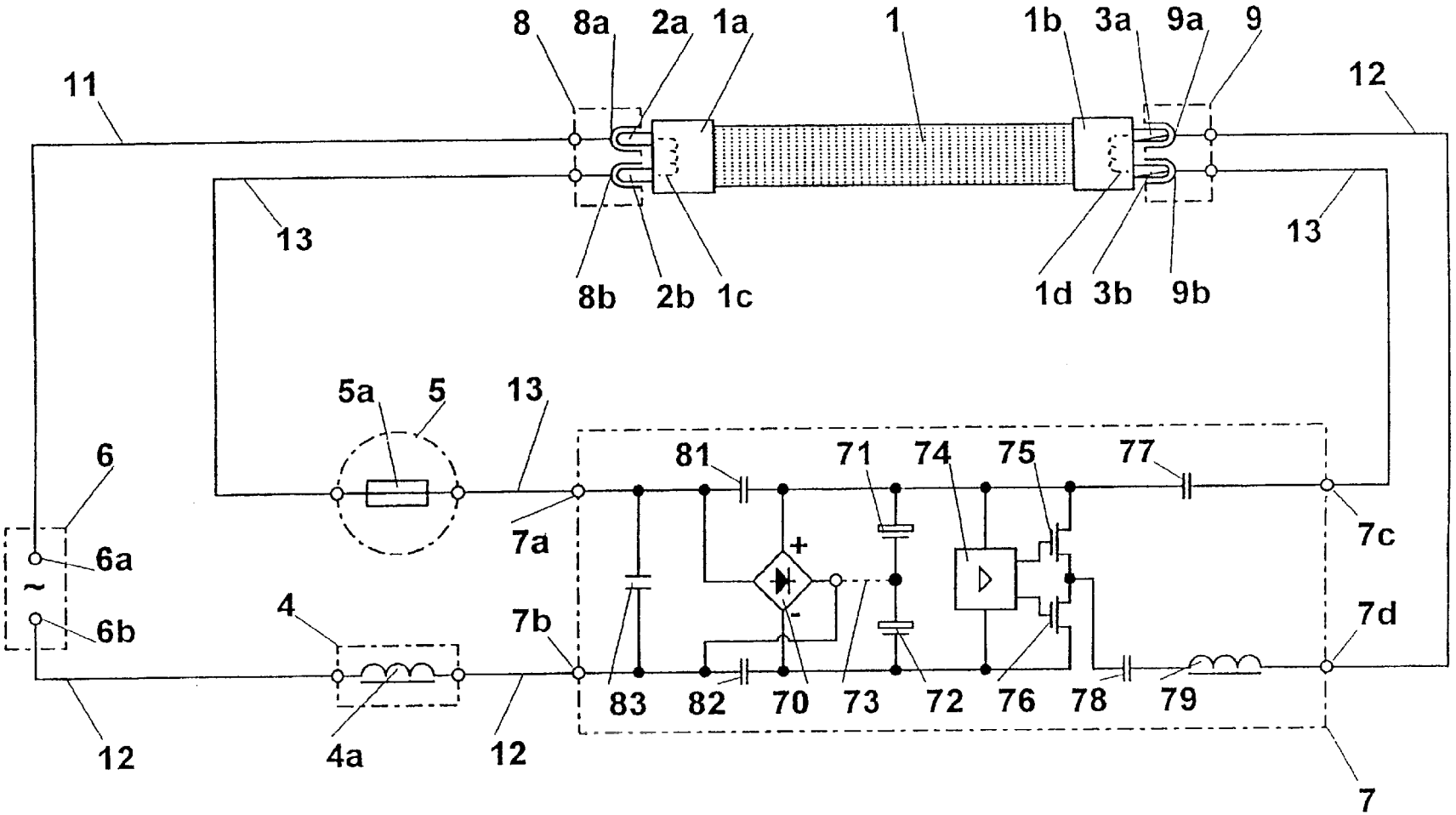
FIG. 1 is a first sample circuit with an inventive circuit arrangement.
Figure 2:
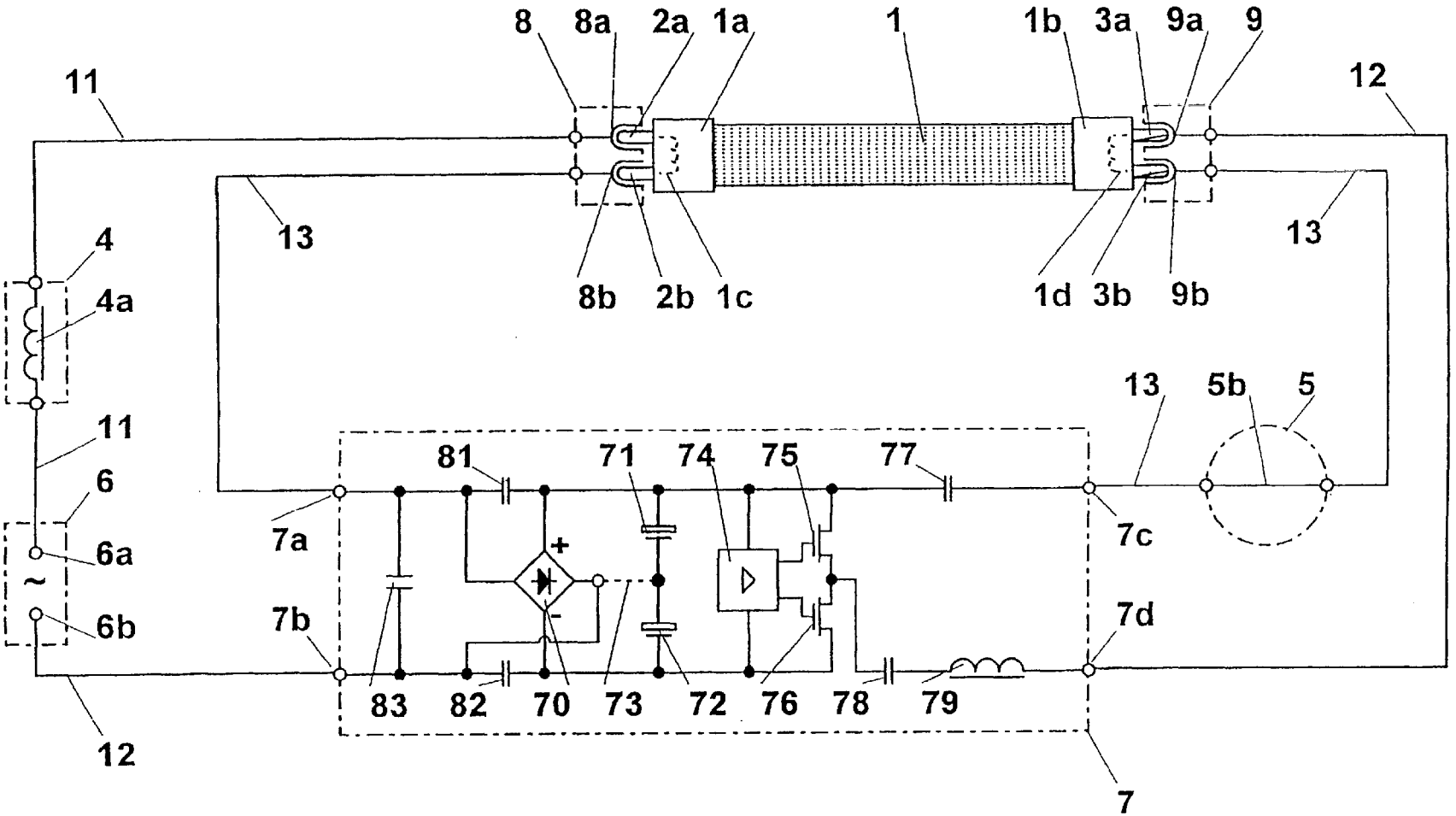
FIG. 2 is a second sample circuit with an inventive circuit arrangement.
Figure 3:
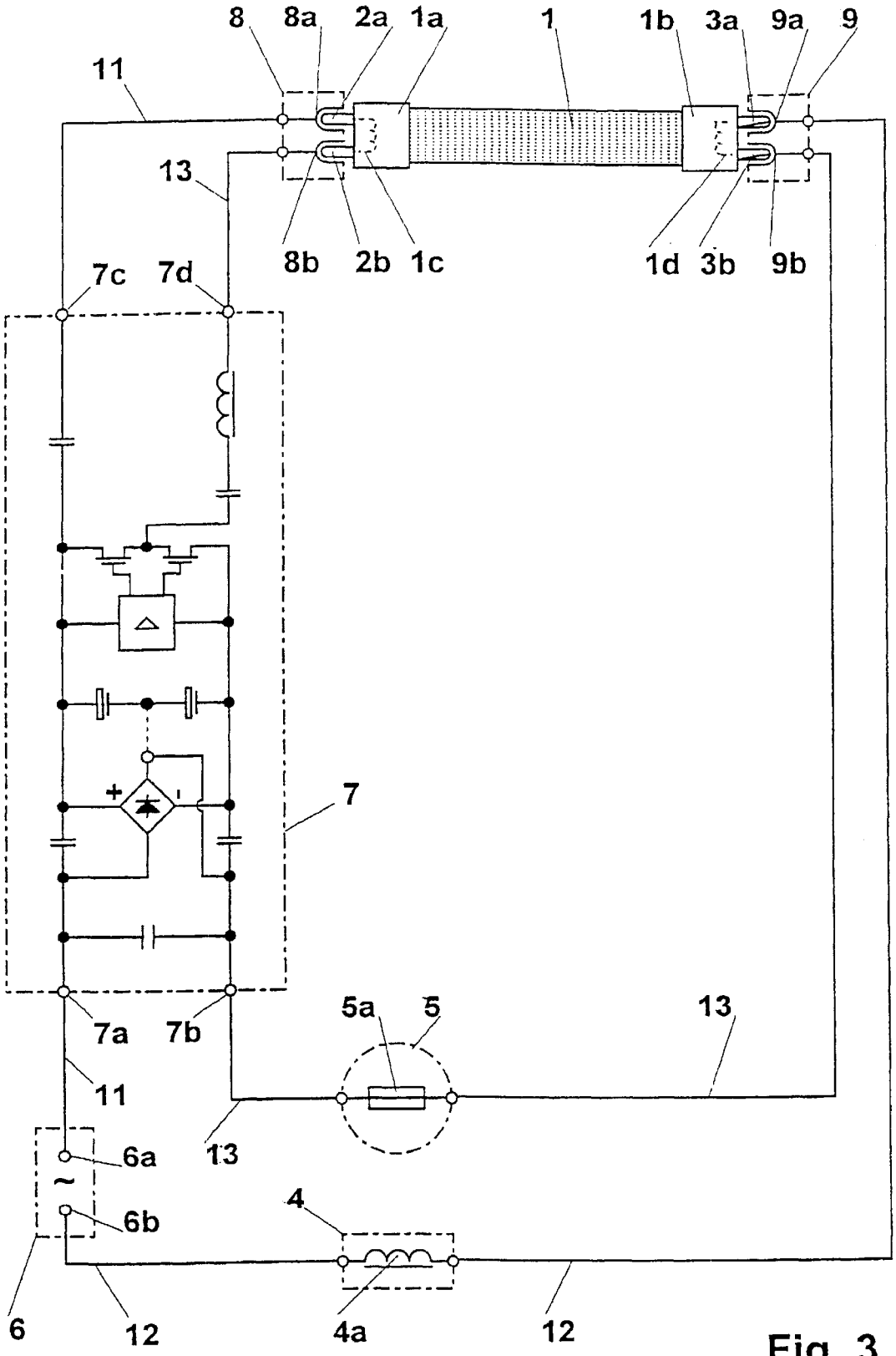
FIG. 3 is a third sample circuit with an inventive circuit arrangement.

FIGS. 1 to 3 schematically show a commercially available fluorescent tube 1 in a straight design. The fluorescent tube 1 comprises two connector pins each 2*a,* 2*b* or 3*a,* 3*b,* respectively, at both end caps 1*a,* 1*b.* The fluorescent tube 1 is accommodated between two oppositely arranged brackets 8, 9 via the connector pins 2*a,* 2*b* or 3*a,* 3*b,* respectively. On the one hand, the brackets 8, 9 carry the fluorescent tube 1 mechanically, on the other hand, the brackets 8, 9 comprise contact receptacles 8*a,* 8*b* or 9*a,* 9*b,* respectively, in order to make an electrical connection with the connector pins 2*a,* 2*b* or 3*a,* 3*b,* respectively, of the fluorescent tube 1. As is known, rotating brackets are a choice for this purpose, between which the fluorescent tube is inserted vertically and by rotating through an angle of 90° makes contact and is mechanically locked. The connection of the fluorescent tube 1 with an alternating current supply 6 is now made in a known manner under interconnecting a ballast comprising a solenoid 4*a,* which is simply referred to as reactance coil 4, as well as a starter 5.

For this purpose, a contact receptacle 8*a* of a bracket 8 is directly connected with a pole 6*a* of the alternating current supply 6 according to FIG. 1. A contact receptacle 9*a* of the other bracket 9 is connected with the other pole 6*b* of the alternating current supply 6 via a second line 12, with the reactance coil 4 being interconnected in the second line 12. Moreover, a contact receptacle 8*b* of the one bracket 8 is connected with a contact receptacle 9*b* of the other bracket 9 via a third line 13 in which the starter 5 is interconnected.

Due to the alternating current operation, it is of no significance whether the connector pins 2*a,* 2*b,* or 3*a,* 3*b,* respectively, of the fluorescent tube 1, the contact receptacles 8*a,* 8*b* or 9*a,* 9*b,* respectively, of the brackets 8, 9, or the poles 6*a,* 6*b* of the alternating current supply 6 are interchanged among each other. For the same reason as shown in FIG. 2, the reactance coil 4 can be interconnected in the first line 11, instead of in the second line 12 as shown in FIG. 1.

The inventive circuit arrangement is designed as a quadripole 7 which is interconnected in the second and third line 12, 13 according to FIGS. 1 and 2. Thus the input terminals 7*a,* 7*b* of the quadripole 7 form a series connection with the contact receptacles 8*a,* 8*b* of the one bracket or of the one thermionic cathode 1*c,* respectively, of the fluorescent tube 1, the reactance coil 4, and the starter 5, which is connected parallel to the alternating current supply 6. The output terminals 7*c,* 7*d* of the quadripole 7 are electrically connected with the contact receptacles 9*a,* 9*b* of the other bracket 9, or the other thermionic cathode 1*d,* respectively, of the fluorescent tube 1.

Due to the alternating current operation, the same holds true in the connection of the quadripole 7 in that both the poles 7*a,* 7*b* of the input terminals and the poles 7*c,* 7*d* of the output terminals can be interchanged among each other. Likewise, the series connection consisting of input terminals 7*a,* 7*b,* thermionic cathode 1*c,* reactance coil 4, and starter 5, can have any order, for example the one shown in FIG. 2.

Furthermore, the quadripole 7 can be interconnected in the first and third line 11, 13 as is shown in FIG. 3. In this case the input terminals 7*a,* 7*b* of the quadripole 7 form a series connection with the contact receptacles 9*a,* 9*b* of the bracket 9, or the thermionic cathode 1*d,* respectively, of the fluorescent tube 1, the reactance coil 4, and the starter 5, which is connected in parallel to the alternating current supply 6, and the output terminals 7*c,* 7*d* of the quadripole 7 are electrically connected with the contact receptacles 8*a,* 8*b* of the bracket 8, or the thermionic cathode 1*c,* respectively, of the fluorescent tube 1.

According to FIGS. 1 and 3, the starter 5 connected therein in series with the input terminals 7*a,* 7*b,* is designed as an electrical fuse Sa and thus serves as an additional protection of the inventive circuit arrangement. Provided, this additional protection is not desired or required, respectively, the starter 5 must be bridged or short-circuited, respectively. If the starter 5 is bridged by means of a line 5*b* it can also be connected as is shown on FIG. 2 so that the output terminals 7*c,* 7*d* of the quadripole 7 and the starter 5 form a series connection which is electrically connected with the thermionic cathode 1*d* of the fluorescent tube 1.

The quadripole 7 has an identical internal construction in the sample circuits according to FIGS. 1 to 3. The input side of the quadripole 7 is supplied by the alternating current supply 6 so that its output side applies a high-frequency current $I_{HF}$ to one thermionic cathode 1*d* or 1*c,* respectively, of the fluorescent tube. In more detail, this results in the following mode of function:

a.) One thermionic cathode 1*c* or 1*d,* respectively, of the fluorescent tube 1 is always connected in series with the input terminals 7*a,* 7*b* of the quadripole 7 so that this thermionic cathode always carries the input current of the quadripole 7 and is thus preheated.

b.) Moreover, the thermionic cathode 1*c* or 1*d,* respectively, connected in series with the input terminals 7*a,* 7*b* of the quadripole returns the high-frequency current $I_{HF}$ flowing through the other thermionic cathode 1*d* or 1*c,* respectively, to the input side of the quadripole 7 and thus serves as "virtual ground". For the high-frequency current $I_{HF}$ it is basically irrelevant whether it flows directly to ground or whether it flows to ground via the input side of the quadripole 7. Due to the fact that the high-frequency current $I_{HF}$ in this case flows to ground via the input side of the quadripole 7, a "short" path is advantageously provided so that the high-frequency radiation is on the lowest possible level.

c.) Due to the fact that the reactance coil 4 is also always connected in series with the input terminals 7*a,* 7*b* of the quadripole 7, the solenoid 4*a* of the reactance coil 4 functions as a pre-filter which, on the one hand, optimises power as well as the crest factor and, on the other hand, suppresses electromagnetic as well as high-frequency interferences.

d.) The input current of the quadripole 7 amounts to only 30% of the current consumption of a conventionally—i.e. without the inventive circuit arrangement—operating fluorescent tube. In this manner, almost no power dissipation occurs in the reactance coil 4 so that, furthermore, the reactance coil 4 remains cool during operation.

e.) A capacitor 83 is connected in parallel to the input terminals 7*a,* 7*b* of the quadripole 7. The capacitor 83 together with the upstream reactance coil 4 serves as a compensation and causes an increase of the power factor.

f.) A rectifier 70 is connected downstream of the input terminals 7*a,* 7*b* of the quadripole 7, which is usually formed by four diodes in a bridge circuit. Due to the fact that the high-frequency current IHF superposes the input current as explained under b.), so-called "fast recovery" diodes are preferably used for the connection of the rectifier 70.

g.) Between the input terminals 7*a,* 7*b* of the quadripole 7 and the plus and minus output of the rectifier 70, preferably one capacitor each 81, 82 is connected or—in other words—the rectifier 70 is quasi bridged by the capacitors 81, 82. This is always necessary if plain and thus low-cost diodes are used for the connection of the rectifier 70 in lieu of the "fast recovery" diodes mentioned under f.). The capacitors 81, 82 namely form a high-frequency short-circuit link via which the high-frequency current IHF which superposes the input current can flow off as explained under b.).

h.) Two smoothing capacitors 71, 72 which are connected in series are connected parallel to the plus and minus output of the rectifier 70. The connection point of the smoothing capacitors 71, 72 can be bridged to one of the input terminals 7*a,* 7*b* of the quadripole 7 by means of a line 73 in order to enable the adaptation of the overall capacitance of the smoothing capacitors 71, 72 to different voltages of the alternating current supply 6, e.g. 110 V or 220 V.

i.) Between the plus output of the rectifier 70 and one of the output terminals 7*c,* 7*d* of the quadripole 7 a coupling capacitor 77 is connected so that the thermionic cathode 1*d* or 1*c,* respectively, to which the high-frequency current $I_{HF}$ is applied is preheated during the starting phase of the fluorescent tube 1.

k.) Two transistors 75, 76 which are driven by a control circuit 74, as well as a solenoid 79 form a high-frequency stage for the generation of the high-frequency current $I_{HF}$. The high-frequency stage is connected between the plus and the minus output of the rectifier 70 and the output terminals 7*c,* 7*d* of the quadripole 7. The control circuit 74 can, for example, be an annular core transformer. However, in order to reduce the power dissipation and the heat emission associated therewith, it is advantageous to use a commercially available driver IC for the control circuit 74 and to employ transistors 75, 76 of the MOSFET type.

l.) A blocking capacitor 78 is connected in series with the output of the high-frequency stage or the solenoid 79, respectively. The blocking capacitor 78 prevents the low-frequency current from the alternating current supply 6 from flowing through the fluorescent tube 1, which would expose the high-frequency stage to the high voltage of the alternating current supply 6 and thus damage same.

Figure 4:
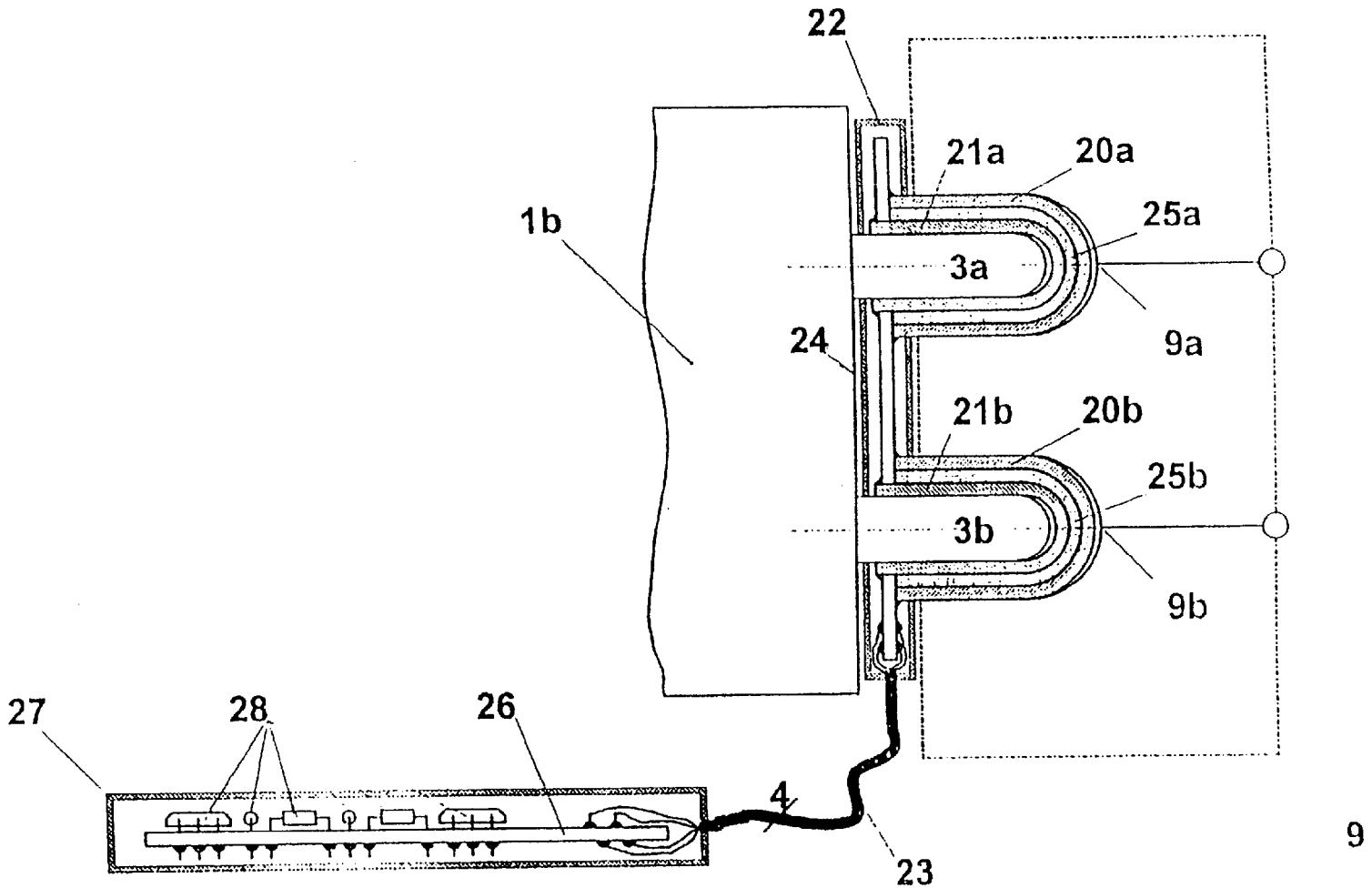
FIG. 4 shows a first embodiment of an inventive device for the connection of an inventive circuit arrangement.

FIG. 4 schematically shows a sectional view of an inventive device for connecting an inventive circuit arrangement with the fluorescent tube 1. The components 28 of the inventive circuit arrangement are installed as an electr(on)ic circuit in a known manner on a circuit board 26 which is accommodated in a housing 27 for protection.

The inventive device comprises two connector pins 20*a,* 20*b* which herein are electrically and mechanically accommodated in the right hand bracket 9. The connector pins 20*a,* 20*b* are formed as hollow pins. Coaxial with the connector pins 20*a,* 20*b* contact receptacles or connection sockets, respectively, 21*a,* 21*b* are arranged in the respective interior. The connector pins 3*a,* 3*b* of the r.h. end cap 1*b* of the fluorescent tube 1 are electrically and mechanically accommodated in the contact receptacles or connection sockets, respectively, 21*a,* 21*b.* The connector pins 20*a,* 20*b* and the contact receptacles or connection sockets, respectively, 21*a,* 21*b* are isolated from each other by means of a layer 25*a,* 25*b* made from an insulating material. The connector pins 20*a,* 20*b* as well as the contact receptacles or connection sockets, respectively, 21*a,* 21*b* are secured or soldered, respectively, to a circuit board 24. The circuit board 24 herein comprises (four) conductors not shown in detail which lead to solder connections from which the one end of a four-conductor cable 23 starts. At its other end the cable 23 is connected with the circuit board 26 of the inventive circuit arrangement designed as the quadripole 7 via solder connections. Thereby the connector assignment is provided in such a manner that the connector pins 20*a,* 20*b* are connected with the input terminals 7*a,* 7*b* of the quadripole 7, and the contact receptacles or connection sockets, respectively, 21*a,* 21*b* are connected with the output terminals 7*c,* 7*d* of the quadripole 7. In this way—equivalent to the sample circuits according to FIGS. 1 and 2—the input terminals 7*a,* 7*b* of the quadripole 7 are connected in series with the contact receptacles 8*a,* 8*b* of the 1.h. bracket 8, and the output terminals 7*c,* 7*d* of the quadripole 7 are connected with the connectors pins 3*a,* 3*b* or the thermionic cathode 1*c,* respectively, at the r.h. end cap 1*b* of the fluorescent tube 1.

A housing 22 serves to accommodate the inventive device in a protective manner. Due to the fact that the connector pins 20*a,* 20*b* and the contact receptacles or connection sockets, respectively, 21*a,* 21*b* are arranged coaxially to one another, the inventive device has such a narrow installation size that the housing 22 fits into the gap between fluorescent tube 1 and bracket 9, which is provided anyway. It is understood that one/both housing(s) 22, 27 can be equipped with connections so that the cable 23 can be disconnected, for example, via plug-in contacts or, if different cable lengths are required, be replaced.

Figure 5:
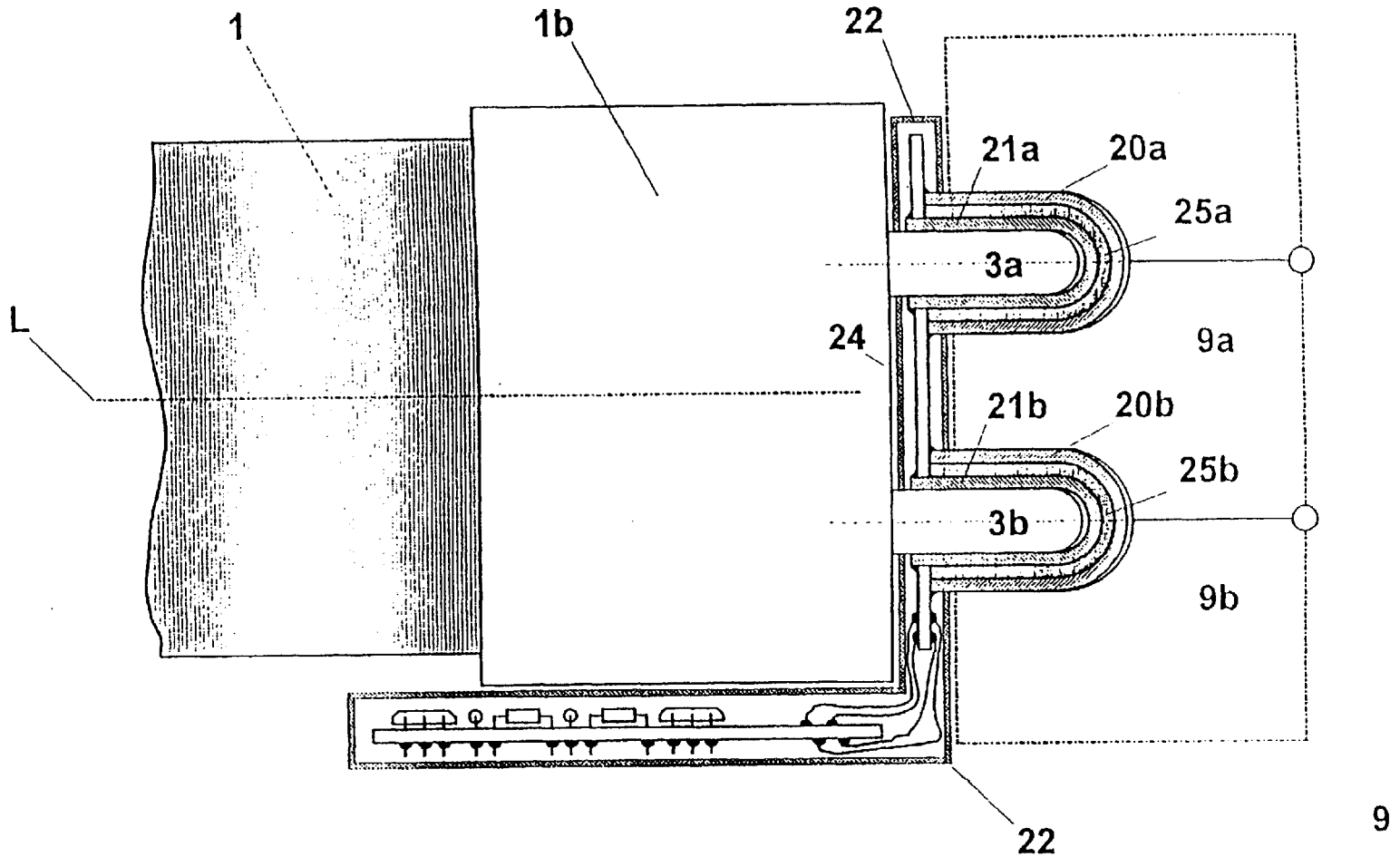
FIG. 5 shows a second embodiment of an inventive device for the connection of an inventive circuit arrangement, with identical components being identified by the same reference numerals.

Compared to FIG. 4, the embodiment of the inventive circuit arrangement according to FIG. 5 is arranged in the housing 22 of the inventive device or—in other words—both are arranged in a common housing 22. Therein housing 22 comprises an extension for accommodating the circuit board 27 of the inventive circuit arrangement, which extends parallel to the longitudinal axis L of the fluorescent tube 1. This results in a particularly compact unit which can be retrofitted in a particularly simple manner, regardless of the physical conditions prevailing in. the electrical appliance in which it is employed. It is understood, that the circuit boards 24, 26 can be combined to a common circuit board in alternative versions.

Finally, it should be noted that although the description of the figures primarily deals with a straight design of the fluorescent tube, it is nevertheless possible to utilise the invention for other fluorescent tube designs as well, for example, arc-shaped designs, as it is known for those with skill in the art.

What is claimed is:

1. A circuit arrangement for the energy saving operations of a fluorescent tube (1), which:

comprises two connections each (2*a,* 2*b;* 3*a,* 3*b*) at both end caps (1*a,* 1*b*);

is electrically and mechanically accommodated in brackets (8, 9) via the connections (2*a,* 2*b;* 3*a,* 3*b*), and is connectable with an alternating current supply (6) by interconnecting a reactance coil (4) and a starter (5);

characterized that:

the circuit arrangement is a quadripole (7) which transforms the current fed to its input terminals (7*a,* 7*b*) from the alternating current supply (7) into a high-frequency current which is output at its output terminals (7*c,* 7*d*);

whose input terminals (7*a,* 7*b*) form a series connection with the two connections (2*a,* 2*b;* 3*a,* 3*b*) at the one end cap (1*a,* 1*b*) and the reactance coil (4), the series connection being connected in parallel to the alternating current supply (6), and whose output terminals (7*c,* 7*d*) are electrically connected with the two connections (2*a,* 2*b;* 3*a,* 3*b*) at the other end cap (1*b,* 1*a*).

2. The circuit arrangement according to claim 1, characterized in that the input terminals (7*a,* 7*b*) form a series connection with the two connections (2*a,* 2*b;* 3*a,* 3*b*) at the one end cap (1*a,* 1*b*) and the reactance coil (4), and the starter (5), which is connected in parallel to the alternating current supply (6), with the starter (5) being bridged.

3. The circuit arrangement according to claim 1, characterized in that the input terminals (7*a,* 7*b*) form a series connection with the two connections (2*a,* 2*b;* 3*a,* 3*b*) at the one end cap (1*a,* 1*b*) and the reactance coil (4), and the starter (5), which is connected in parallel to the alternating current supply (6), with the starter (5) being an electric fuse (5*a*) .

4. The circuit arrangement according to claim 1, characterized in that the output terminals (7*c,* 7*d*) and the starter (5) form a series connection which is electrically connected with the two connections (3*a,* 3*b;* 2*a,* 2*b*) at the other end cap (1*b,* 1*a*), with the starter (5) being bridged.

5. The circuit arrangement according to claim 1, characterized in that a rectifier (70) is connected downstream of the input terminals (7*a,* 7*b*) with one capacitor being connected in parallel to the plus and minus output (=,–) of said rectifier.

6. The circuit arrangement according to claim 5, characterized in that one capacitor each (81, 82) is connected between the input terminals (7*a,* 7*b*) of the quadripole (7) and the plus and minus output (+, –) of the rectifier (70) .

7. The circuit arrangement according to claim 5, characterized in that a coupling capacitor (77) is connected between the plus output (+) of the rectifier (70) and one of the output terminals (7*c,* 7*d*).

8. The circuit arrangement according to claim 5, characterized in that a high-frequency stage is connected between the plus and minus output (+, –) of the rectifier (70) and the output terminals (7*c,* 7*d*), which consists of at least one control circuit (74), at least two transistors (75, 76) as well as at least one solenoid (79).

9. The circuit arrangement according to claim 8, characterized in that a blocking capacitor (78) is connected in series with the solenoid (79).

10. The circuit arrangement according to claim 1, characterized in that the circuit arrangement is integrated in the fluorescent tube (1).

11. The circuit arrangement according to claim 1, characterized in that the circuit arrangement in one of the brackets (8, 9).

12. The circuit arrangement according to claim 1, characterised in that the circuit arrangement is connected with the fluorescent tube (1) by a device, wherein:

the device comprises two connections (20*a,* 20*b*) which can be accommodated in one of the brackets (8, 9);

the device comprises contact receptacles (21*a,* 21*b*) being respectively provided coaxially within the connections (20*a,* 20*b*) in which the connections (2*a,* 2*b;* 3*a,* 3*b*) of one of the end caps (1*a,* 1*b*) of the fluorescent tube (1) can be accommodated;

the connections (20*a,* 20*b*) and the contact receptacles (21*a,* 21*b*) are electrically insulated against each other, and the connections (20*a,* 20*b*) are electrically connected with the input terminals (7*a,* 7*b*) of the quadripole (7), and the contact receptacles (21*a,* 21*b*) are electrically connected with the output terminals (7*c,* 7*d*) of the quadripole (7).

13. The device according to claim 12, characterized in that the device is accommodated in a housing (22) which is arranged between one end cap (1*a,* 1*b*) of the fluorescent tube (1) and one bracket (8, 9).

14. The device according to claim 12, characterized in that the electrical connection between the device and the circuit arrangement designed as quadripole (7) is effected via an electrical cable (23).

15. The device according to claim 13, characterized in that the circuit arrangement designed as quadripole (7) is arranged within the housing (22) of the device.

16. The device according to claim 15, characterized in that the housing (22) of the inventive device comprises an extension extending along the fluorescent tube, which accommodates the circuit arrangement designed as quadripole (7).

17. An employment of at least one circuit arrangement according to one of claims 1 to 10 for the energy-saving operation of at least one fluorescent tube in an electrical appliance.

18. The circuit arrangement according to claim 1, characterised in that a rectifier (70) is connected downstream of the input terminals (7*a,* 7*b*) with at least two smoothing capacitors (71, 72) being connected in parallel to the plus and minus output (+, −) of said rectifier.

19. The circuit arrangement according to claim 1, characterised in that the circuit arrangement is integrated in one of the end caps (1*a,* 1*b*).

20. The device according to claim 12, characterised in that the electrical connection between the device and the circuit arrangement designed as quadripole (7) is effected via an electrical four-wire cable (23).

* * * * *